US008579390B2

(12) United States Patent
Bruestle et al.

(10) Patent No.: US 8,579,390 B2
(45) Date of Patent: Nov. 12, 2013

(54) SUPPORTING STRUCTURE FOR A FURNITURE BODY TO BE INSTALLED ON THE WALL

(75) Inventors: Klaus Bruestle, Höchst (AT); Helmut Hollenstein, Lustenau (AT)

(73) Assignee: Julius Blum GmbH, Hochst (AT)

( * ) Notice: Subject to any disclaimer, the term of this patent is extended or adjusted under 35 U.S.C. 154(b) by 2 days.

(21) Appl. No.: 13/114,363

(22) Filed: May 24, 2011

(65) Prior Publication Data

US 2011/0221317 A1 Sep. 15, 2011

Related U.S. Application Data

(63) Continuation of application No. PCT/AT2009/000497, filed on Dec. 28, 2009.

(30) Foreign Application Priority Data

Jan. 16, 2009 (AT) ..... A 68/2009

(51) Int. Cl.
*A47B 67/02* (2006.01)
*A47F 5/08* (2006.01)

(52) U.S. Cl.
USPC ..... 312/247; 312/319.5; 312/306

(58) Field of Classification Search
USPC ..... 312/247, 306, 312, 319.4–319.8, 283, 312/29, 21, 328, 325
See application file for complete search history.

(56) References Cited

U.S. PATENT DOCUMENTS 2,592,760 A * 4/1952 Sutera ..... 312/312
2,889,442 A * 6/1959 Schultz ..... 219/398
2,944,540 A * 7/1960 Littell, Jr. ..... 126/273 A
3,415,586 A * 12/1968 Hammond ..... 312/312

(Continued)

FOREIGN PATENT DOCUMENTS

AT 503 671 11/2008
DE 3409990 7/1984

(Continued)

OTHER PUBLICATIONS

International Search Report issued May 11, 2010 in International (PCT) Application No. PCT/AT2009/000497.

(Continued)

*Primary Examiner* — Katherine Mitchell
*Assistant Examiner* — Andres F Gallego
(74) *Attorney, Agent, or Firm* — Wenderoth, Lind & Ponack, L.L.P.

(57) ABSTRACT

A supporting structure includes an outer body and an inner body that can be lowered. The supporting structure includes two side elements to be installed on the wall at a distance from each other, and at least one cross member detachably connecting the side elements to each other. The supporting structure also has separate fastening points for independently installing the outer body and the inner body on the supporting structure. Each side element has a preferably preinstalled, vertically movable supporting element on the inside facing the inner body, and the supporting elements have the fastening points for the inner body.

16 Claims, 12 Drawing Sheets

(56) References Cited

U.S. PATENT DOCUMENTS

| | | | | |
|---|---|---|---|---|
| 3,729,245 | A * | 4/1973 | Skifstrom | 312/312 |
| 4,076,351 | A | 2/1978 | Wyant | |
| 4,856,854 | A * | 8/1989 | Nishiyama et al. | 312/34.11 |
| 5,203,619 | A * | 4/1993 | Welsch et al. | 312/247 |
| 5,305,898 | A * | 4/1994 | Merl | 211/87.01 |
| 5,586,816 | A * | 12/1996 | Geiss, II | 312/301 |
| 5,950,974 | A * | 9/1999 | Hoffmann | 248/223.41 |
| 6,471,311 | B1 * | 10/2002 | Snyder | 312/247 |
| 6,484,893 | B1 * | 11/2002 | Tkatch | 211/94.02 |
| 7,770,986 | B1 * | 8/2010 | Simaitis | 312/247 |
| 8,424,983 | B1 * | 4/2013 | Strauss et al. | 312/247 |
| 2006/0284530 | A1 * | 12/2006 | Hollenstein | 312/327 |

FOREIGN PATENT DOCUMENTS

| | | | |
|---|---|---|---|
| DE | 3409990 | A1 * | 7/1984 |
| EP | 0 402 283 | | 12/1990 |
| FR | 2 783 142 | | 3/2000 |
| JP | 2001-114497 | | 4/2001 |
| JP | 2007-260200 | | 10/2007 |
| WO | 95/12335 | | 5/1995 |
| WO | 2007/131251 | | 11/2007 |

OTHER PUBLICATIONS

Austrian Patent Office Search Report issued Nov. 4, 2009 in corresponding Austrian Patent Application No. A 68/2009.

* cited by examiner

SUPPORTING STRUCTURE FOR A FURNITURE BODY TO BE INSTALLED ON THE WALL

This application is a Continuation of International application No. PCT/AT2009/000497, filed Dec. 28, 2009, the entire disclosure of which is incorporated herein by reference.

BACKGROUND OF THE INVENTION

The present invention relates to a supporting structure for a furniture carcass to be mounted to a wall, having an outer carcass and an inner carcass which can be lowered relative thereto. The supporting structure includes two side elements which are to be mounted to the wall in a mutually spaced relationship, and at least one transverse member which can releasably connect the side elements together. The supporting structure has separate fastening locations for independently mounting the outer carcass and the inner carcass to the supporting structure.

The invention further concerns an article of furniture having a supporting structure of the kind to be described and a method of mounting an article of furniture to a wall.

An article of furniture having an outer carcass and an inner carcass which can be lowered relative thereto is known for example from AT 503 671 B1. In that case, the inner carcass is motionally coupled to an upwardly movable flap by way of an actuating drive and a transmission mechanism. A relatively stable outer carcass is to be provided for mounting the mechanically relatively heavily loaded actuating drive.

The JP 2007-260200 reference describes a supporting structure for an upper cupboard which can be lowered and which is mounted movably in respect of height relative to a wall panel to be mounted to the wall. Mounted to the wall panel are carriers to which a decorative panel is fitted. When the upper cupboard is in a raised position, the open cupboard compartment of the upper cupboard is concealed by the decorative panel.

SUMMARY OF THE INVENTION

It is an object of the present invention to simplify mounting of such an article of furniture to a wall, in which respect the need for a stable outer carcass can also be eliminated.

According to the invention that is achieved by the features of the present invention. Further advantageous configurations of the invention are recited in the appendant claims.

According to the invention it is provided that, on the inside that is towards the inner carcass, each side element has a, preferably pre-mounted, vertically movable supporting element. The supporting elements have the fastening locations for the inner carcass. In that way, the inner carcass is movable vertically relative to the side elements fastened to the wall, in which case the movement of the supporting elements (and therewith the inner carcass) can also be effected by an electric drive device. The inner carcass can be moved from an upper end position—in which the inner carcass is substantially completely received between the side elements—into a lower end position, whereby the inner carcass can be more easily filled with items to be stowed therein.

The two side elements and the transverse member which connects the side elements together can form a U-shaped profile in the mounted position. That U-shaped profile can be pre-mounted to the wall in a mounting step. The side elements with the transverse member form a skeleton-like structure, and the fastening locations for the inner carcass are provided at the inside of the supporting structure and the fastening locations for the outer carcass are provided at the outside of the supporting structure.

The proposed supporting structure makes it possible for the inner carcass to be mounted to the supporting structure independently and in an uncoupled relationship from the outer carcass. That is to say that the outer carcass is relieved of the load of the weight of the inner carcass. It is therefore not necessary for the outer carcass to be made from a solid wood material (such as for example chipboards or solid wood boards). Rather, it may be sufficient if the outer carcass assumes a purely decorative function to achieve a clean neat image. Therefore, the outer carcass can basically be formed from a light structural material (such as for example lightweight building panels involving a honeycomb structure). The arrangement of an outer carcass on the supporting structure can even be entirely omitted if the image is not adversely affected.

In an embodiment of the invention, it can be provided that at least one side element is at least partially formed from a strut structure. It is therefore not absolutely necessary for the side elements to be produced from flat portions in plate form. By virtue of using a framework-like strut structure, it is possible for the weight of the supporting structure to be considerably reduced, whereby mounting to the wall is also simplified. For stability reasons it may be advantageous if the strut structure is at least partially formed from metal or metal profile members.

In a preferred embodiment of the invention, at least one side element has a, preferably substantially frame-shaped, side portion and an upper portion projecting substantially at a right angle therefrom. The side elements therefore each form an L-shaped profile, wherein the longer limb of the L-shaped profile is associated with the outside of the inner carcass and the shorter limb of the L-shaped profile is associated with the top side of the inner carcass. The transverse member can be connected to the two upper portions of the side elements by way of suitable fastening devices. In that case, the transverse member can be in the form of a modular interchangeable element of various nominal lengths so that the width of the supporting structure can be adapted to correspond to the width of the inner carcass to be mounted. It may also be advantageous for the transverse member to be variable in length (for example telescopically).

To provide for selective adaptation of the supporting structure to the respective dimensions of the inner carcass, it may be desirable if the side elements are adapted to be variable in length in at least one direction. In that case, the supporting structure in its entirety can be adapted to be displaceable in respect of height, laterally displaceable and/or displaceable in respect of depth.

For length adaptation there can be provided at least two portions which can be connected together and which can be releasably connected together in modular-like fashion. To provide for stepless adaptation of the supporting structure to the respective size of the inner carcass, there can be at least two portions which are displaceable relative to each other and which can be fixed after positioning relative to each other.

In the simplest case, the fastening locations for the inner carcass and/or for the outer carcass can be in the form of screw connections. Alternatively, the fastening locations can be in the form of mechanical latching connections, wherein there is provided at least one resilient or spring-loaded latching portion which releases the inner carcass and/or the outer carcass from the supporting structure by pressure against the resilient effect. In that way, the inner carcass and/or the outer carcass can be snapped on to the supporting structure and can also be removed again if required without a tool. In a preferred embodiment of the invention, the outer carcass can be formed from plate-shaped wall portions. As the outer carcass only has to fulfil decorative purposes, it is also possible to provide lightweight boards or panels, as already mentioned.

The article of furniture according to the invention is characterized by at least one supporting structure of the kind in question.

The method according to the invention of fastening an article of furniture—which has an outer carcass and an inner carcass which can be lowered—to a wall is characterised by the following steps:

- mounting two side elements to the wall at a spacing from each other, wherein the side elements each have a vertically movable supporting element,
- inserting the inner carcass between the two side elements,
- connecting the inner carcass to the two supporting elements, and
- connecting the outer carcass to the supporting structure.

BRIEF DESCRIPTION OF THE DRAWINGS

Further details and advantages of the present invention are described with reference to the specific description hereinafter and the drawings, in which.

DETAILED DESCRIPTION OF THE INVENTION

Figure 1:
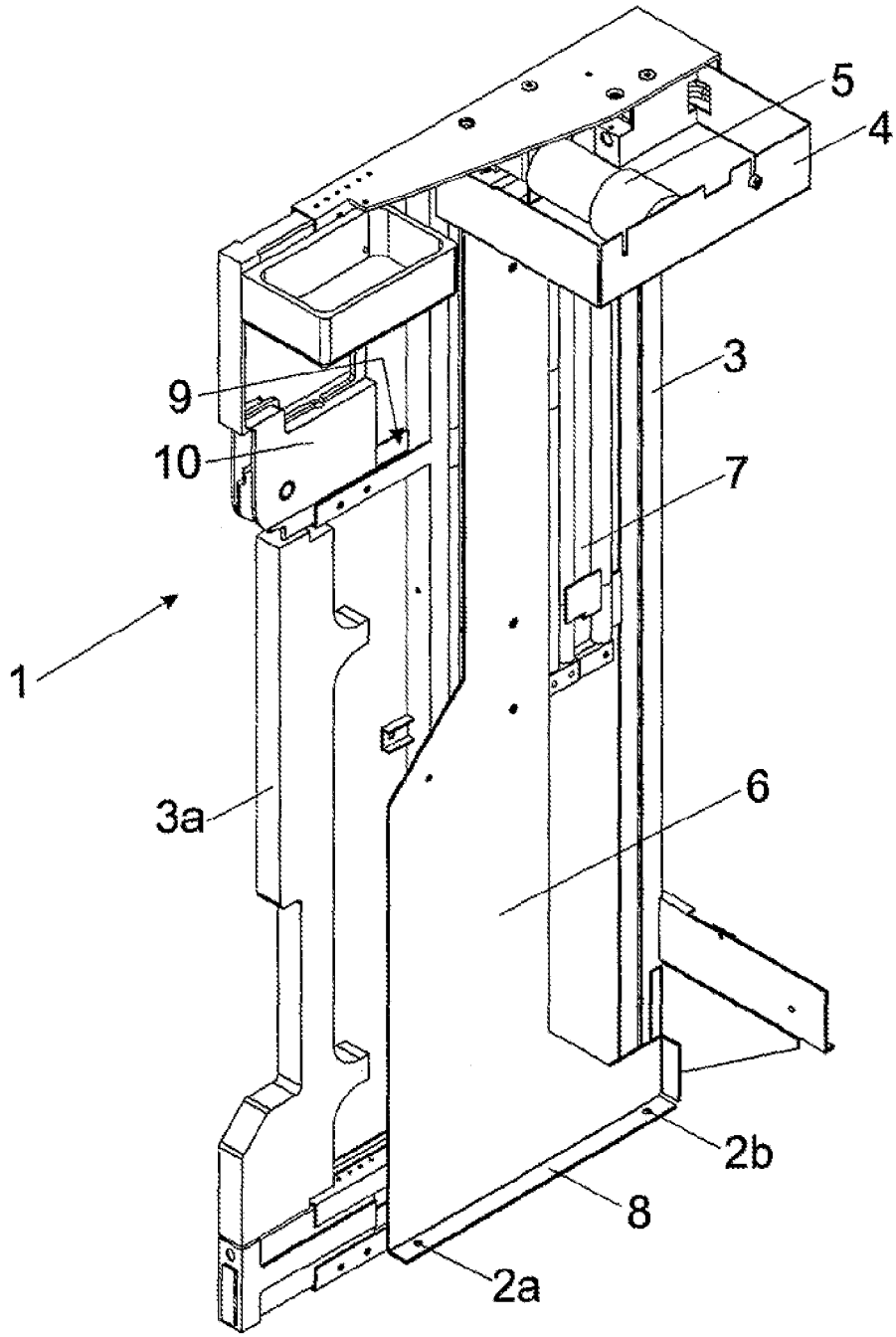
FIG. 1 is a perspective view of a possible embodiment of a side element of the supporting structure according to the invention.

FIG. 1 shows a possible embodiment of a side element 1 of a supporting structure according to the invention, wherein an inner carcass (not shown here) can be fastened at the inside of the side element 1, at diagrammatically indicated fastening locations 2*a* and 2*b*. The framework-like side element 1 is at least partially formed from a strut structure of metal. The side element 1 has a—preferably frame-shaped—side portion 3 (i.e., the side portion 3 has a framework with a strut structure) which is to be stationarily fastened to a wall. An upper portion 4 projecting at a right angle to the side portion 3 is arranged at the top side so that the side element 1 is substantially in the form of an L-shaped profile. The upper portion 4 has a trough-shaped configuration so that an electric drive device 5 for driving the vertically movable supporting element 6 has space to be accommodated therein. The electric drive device 5 acts on the supporting element 6 by way of a transmission mechanism 7 (for example a cable arrangement, a toothed belt and/or a gear transmission), whereby the supporting element 6 is vertically movable relative to the stationary side portion 3. The supporting element 6 which is adjustable in respect of height has a horizontal support limb 8 so that the inner carcass to be mounted can be pushed from the front on to that support limb 8 and can be fixed after positioning by way of the fastening locations 2*a* and 2*b* on the supporting element 6. To adapt the side element 1 to the respective depth of the inner carcass, the side element 1 in the illustrated embodiment is adapted to be displaceable in respect of depth. For that purpose, a movable portion 3*a* is telescopically displaceable relative to the stationary side portion 3 and can be fixed after positioning has been effected. The side element 1 can also be adapted to be displaceable in respect of height in a similar fashion. The side element 1 also has a holding device 9 for a drive device 10 by which a flap which is movable in respect of height relative to the side element 1 is movable between a closed position and an open position.

Figure 2:
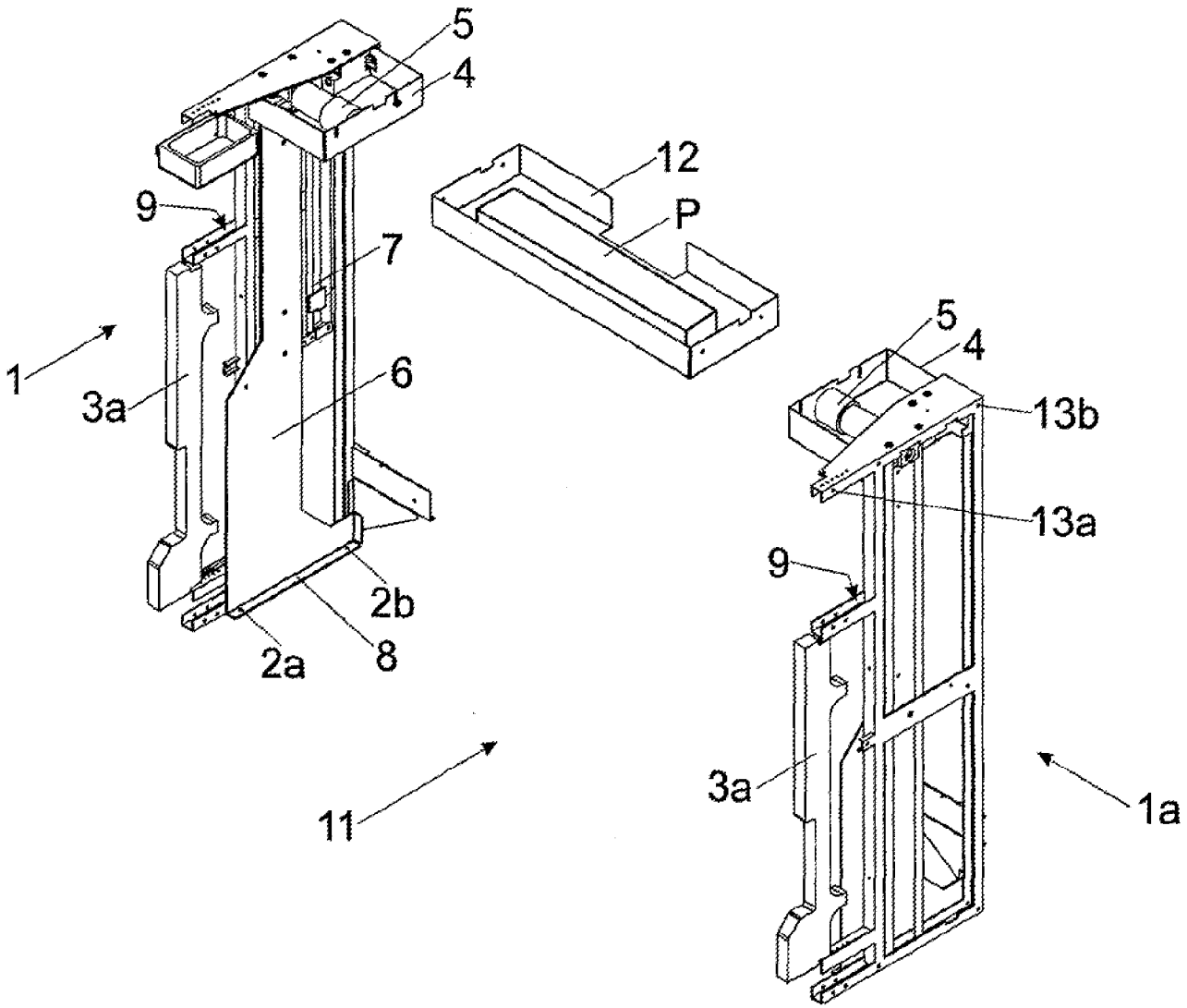
FIG. 2 shows the supporting structure with the two side elements and the transverse member in the released condition.

FIG. 2 shows the supporting structure 11 according to the invention, which in the assembled condition forms a U-shaped profile to be mounted to the wall. The (first) side element 1 which is shown in FIG. 1 and which has already been described can be seen at the left in this view. Shown at the right in the view is a second side element 1*a* which has a similar configuration to the left-hand (first) side element 1, the same parts of the side element 1*a* being denoted by the same reference numbers. At the outside of the right-hand side element 1*a* it is possible to see fastening locations 13*a*, 13*b* by way of which an outer carcass can be fastened to the supporting structure 11. It should be noted that the inner fastening locations 2*a* and 2*b* for the inner carcass and the outer fastening locations 13*a* and 13*b* for the outer carcass are only diagrammatically illustrated. Firstly, the position of the fastening locations 2*a* and 2*b* and the fastening locations 13*a* and 13*b* on the supporting structure 11 can differ from the positions shown in the Figure. In addition, the fastening devices 2*a*, 2*b* and 13*a*, 13*b* can be in the form of screw connections and/or inserts and/or mechanical latching connections which in particular allow mounting and/or removal of the inner carcass and/or the outer carcass on the supporting structure 11, without the use of a tool. In the illustrated embodiment, each side element 1 has an electric drive device 5 for moving the vertically displaceable supporting element 6. It will be appreciated that it is possible to provide only one single electric drive device 5. The upper portions 4 of the two side elements 1 can be releasably connected by way of a transverse member 12. That fastening can also be effected by means of screw connections and/or mechanical latching connections so that the transverse member 12 can be latched to the two upper portions 4 and can be dismantled without a tool. The transverse member 12 has a trough-like configuration so that, for example, a power supply device P for the two electric drives 5 can be accommodated therein.

Figure 3:
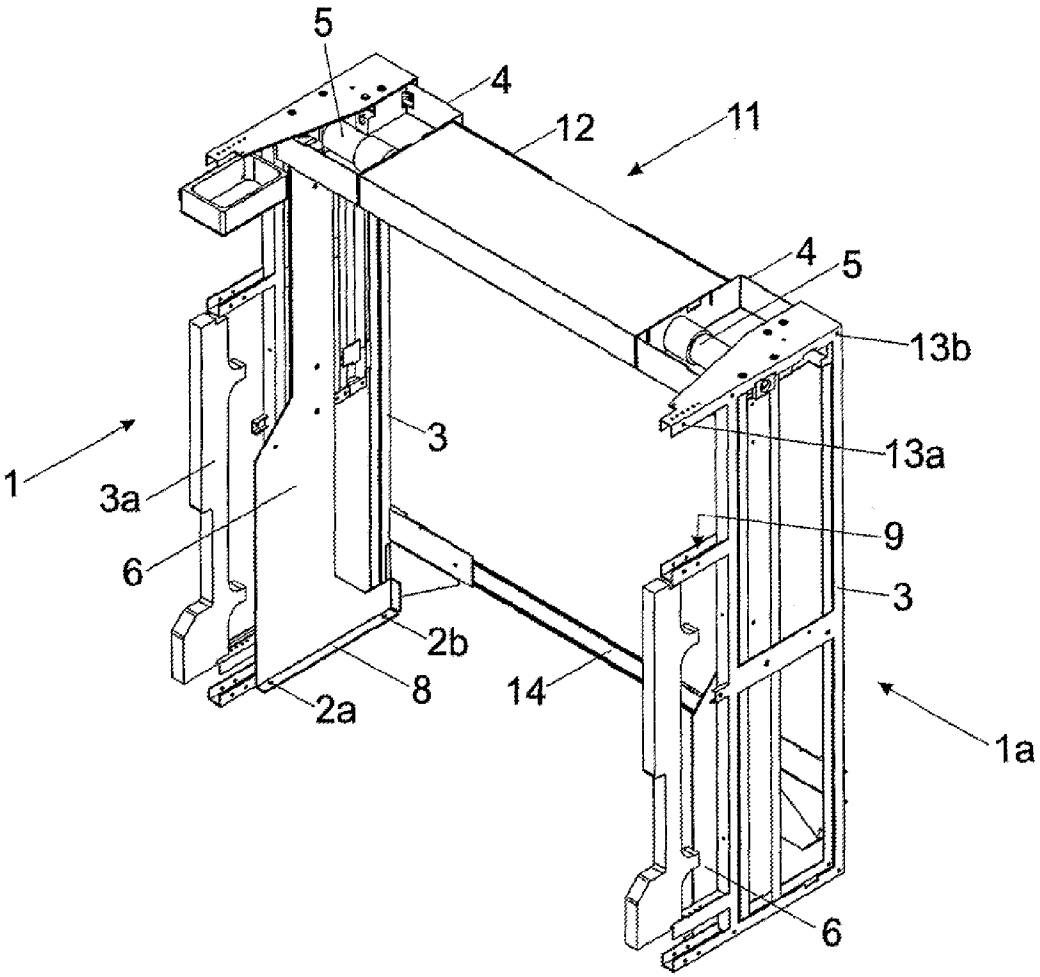
FIG. 3 shows the supporting structure in the assembled condition.

FIG. 3 shows the supporting structure 11 with the two side elements 1, the upper portions 4 of which are connected to the transverse member 12. It is also possible to see the two electric drive devices 5 for raising and lowering the two supporting elements 6. Provided at the inside of the supporting structure 11 are fixing locations 2*a* and 2*b* for the mounting inner carcass, while provided at the outside are fixing locations 13*a* and 13*b* for mounting the outer carcass. The side portions 3 can be connected in the lower region by a strut 14 serving for stability.

Figure 4:
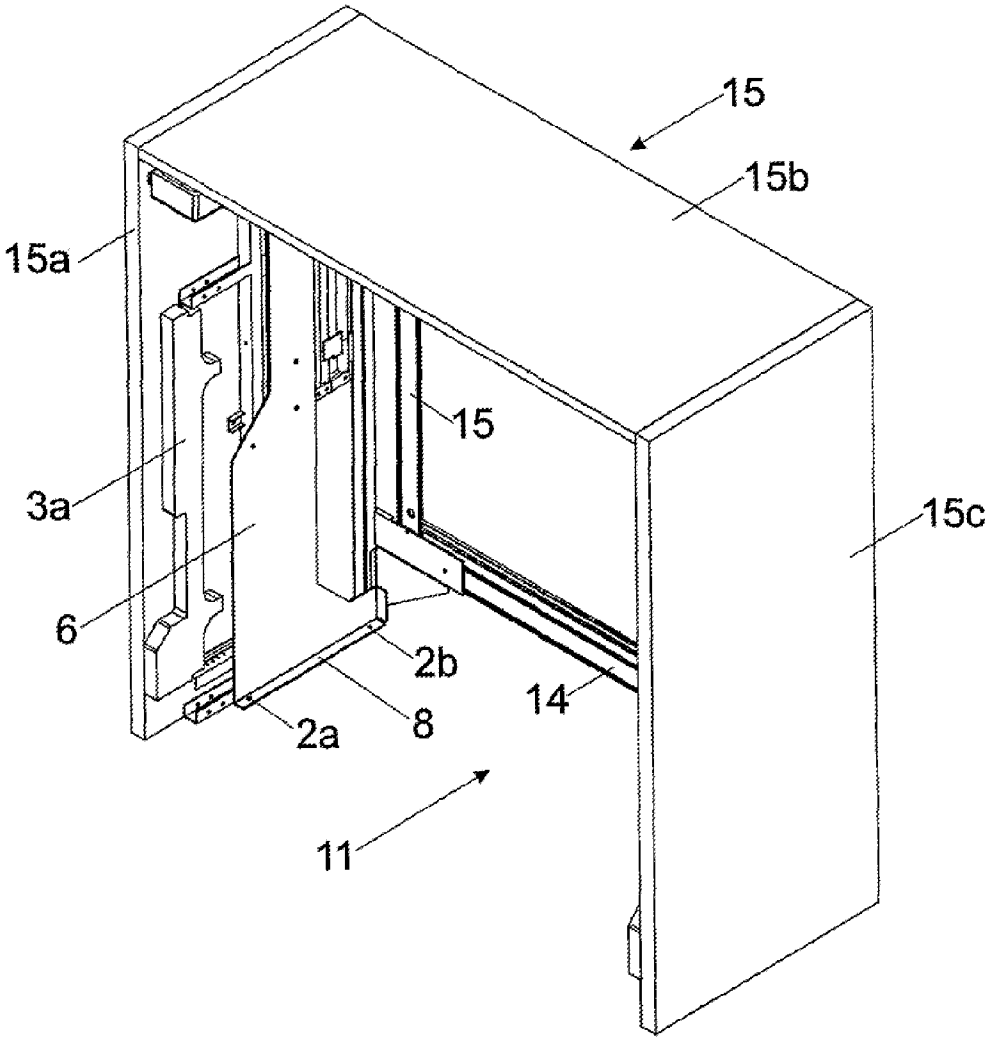
FIG. 4 shows the supporting structure with the outer carcass mounted thereto.

FIG. 4 shows the supporting structure 11 of FIG. 3, to the outside of which the outer carcass 15 has been fastened in a subsequent mounting step. The outer carcass 15 has plate-shaped wall portions 15*a*, 15*b*, 15*c* which were fixed at the outer fastening locations 13*a* and 13*b* diagrammatically shown in FIG. 3. It is possible to see a frame-shaped wall holder 14*a*, by way of which the supporting structure 11 together with the outer carcass 15 can be fixed to a wall.

Figure 5:
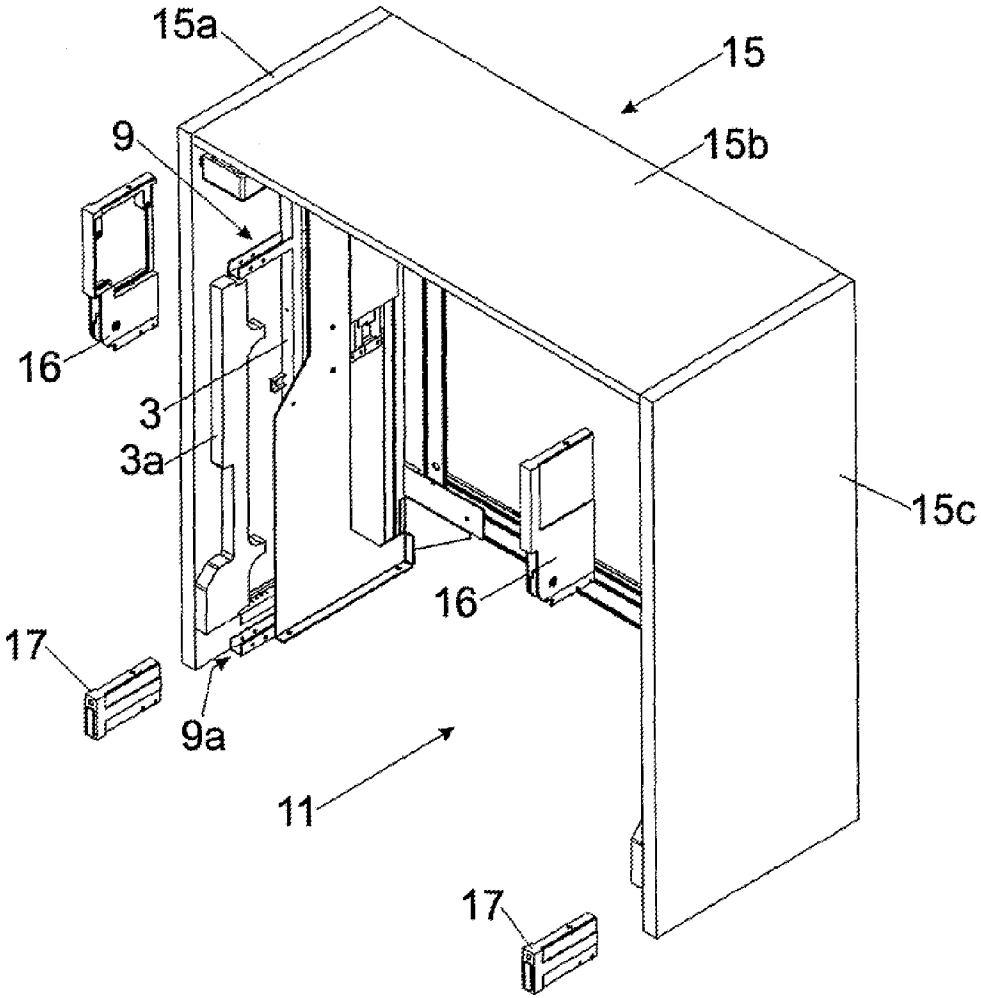
FIG. 5 shows the supporting structure with the drive device to be mounted thereto for a furniture flap and with the switches to be mounted for lowering an inner carcass.

FIG. 5 shows the supporting structure 11 with the mounted outer carcass 15, wherein a drive device 16 can be inserted into and fixed in the holding device 9 of the supporting structure 11. The drive device 16 comprises a spring device (not shown) and/or an electric motor, wherein a vertically movable flap which is still to be fitted in place can be acted upon by the drive device 16. It is also possible to see switches 17 by which a movement of the downwardly movable inner carcass can be triggered. The two switches 17 are held by a holding device 9*a* on the left-hand and right-hand sides of the supporting structure 11. The drive device 16 and/or the switches 17 are mounted displaceably in respect of depth within the holding devices 9 and 9*a* with respect to the side portions 3 (so that they can align in the mounted position with the front edge of the carcass) and can be fixed after positioning has been effected.

Figure 6:
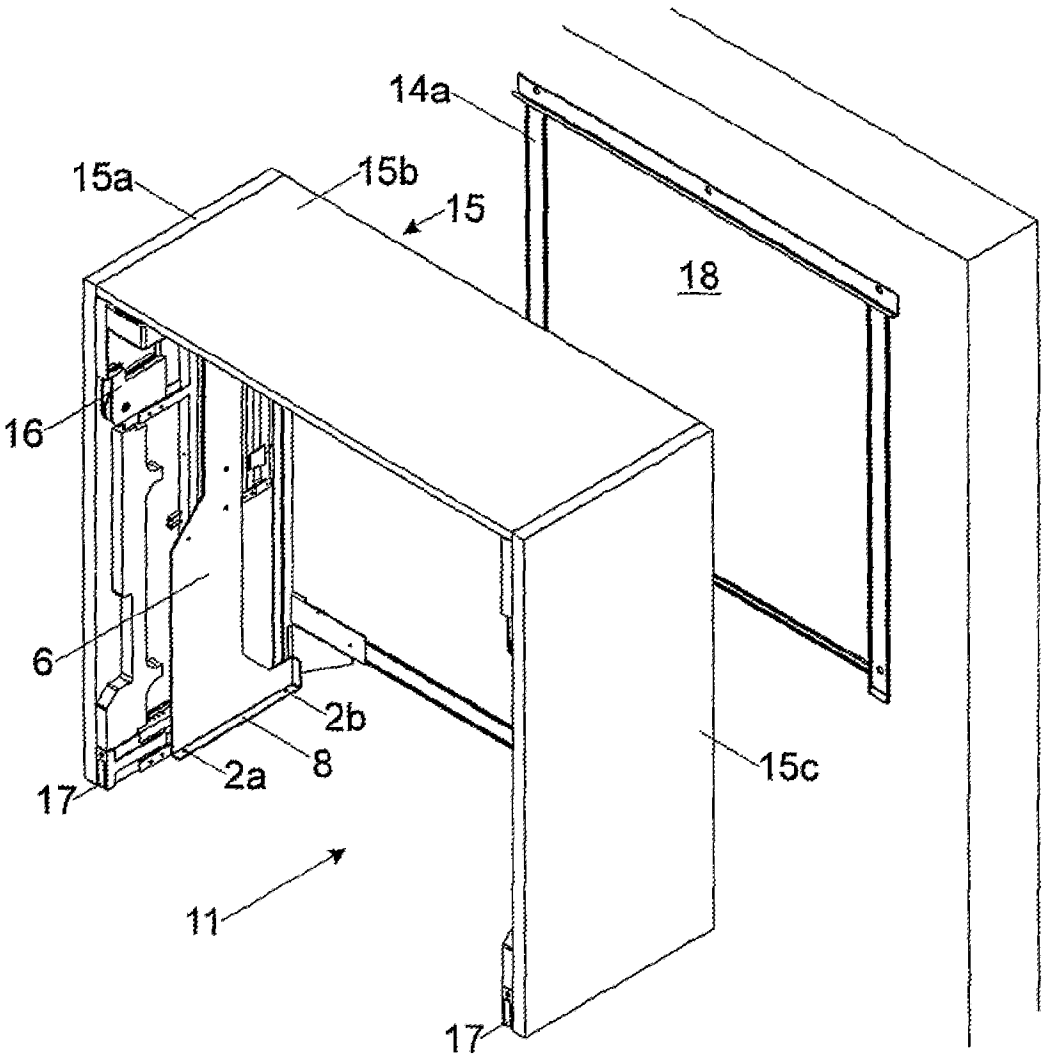
FIG. 6 shows the supporting structure with a mounted outer carcass and a wall holder pre-mounted to the wall.

FIG. 6 shows the supporting structure 11 with the mounted drive device 16 for a furniture flap which is movable in respect of height, as well as the fitted switches 17 for triggering a motor-assisted movement of the vertical movable supporting element 6. A wall 18 is diagrammatically shown, to which the frame-shaped wall holder 14*a* is pre-mounted. It is possible to see the horizontal support limb 8 of the vertically movable supporting element 6, by which the inner carcass which is still to be mounted in place can be pushed in and fixed by the fastening locations 2*a* and 2*b*.

Figure 7:
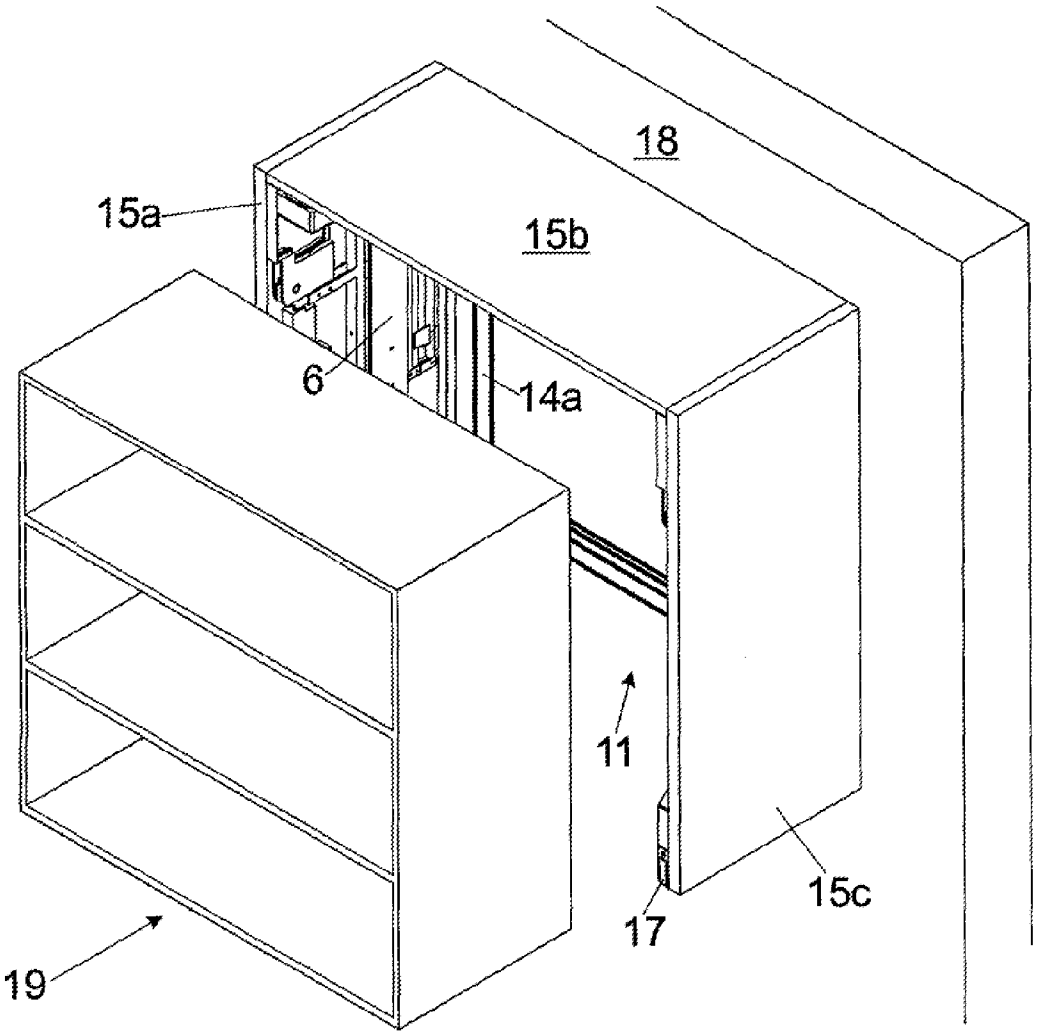
FIG. 7 shows the supporting structure fastened to the wall, with the inner carcass to be mounted to the supporting structure.

FIG. 7 shows the supporting structure 11 fastened to the wall 18, with the outer carcass 15 pre-mounted thereto, with the plate-shaped wall portions 15*a*, 15*b*, 15*c*. In the next mounting step, an inner carcass 19 in cupboard form is pushed on to the support limbs 8 shown in FIG. 6 and provided at the right and at the left, and is fixed by way of the fastening locations 2*a* and 2*b*. The inner carcass 19 is then fixedly connected to the vertically movable supporting elements 6 and can be lowered relative to the outer carcass 15 upon actuation of the switch 17.

Figure 8:
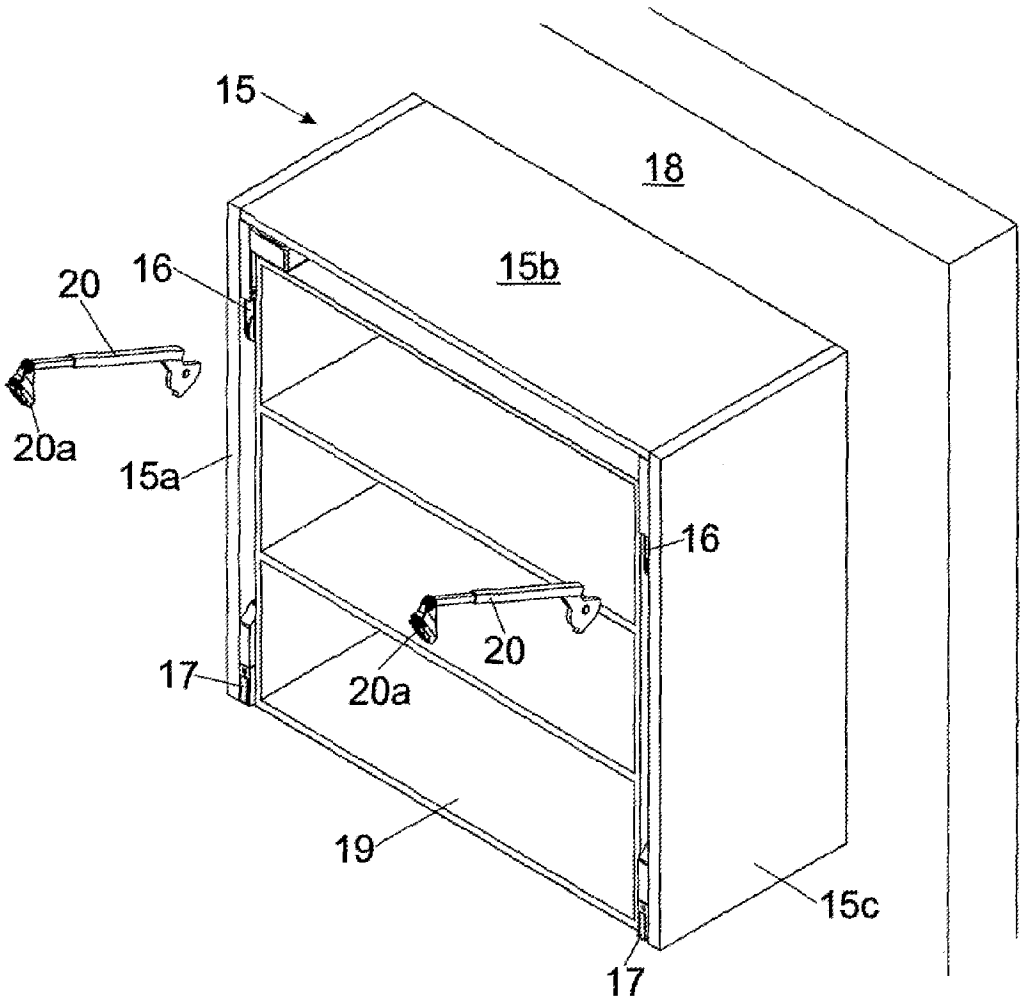
FIG. 8 shows the article of furniture fastened to the wall with the actuating arms to be mounted for moving a vertically movable furniture flap.

FIG. 8 shows the supporting structure 11 with the outer carcass 15 fastened thereto at the outside and the box-shaped inner carcass 19 which is fastened at the inside. In a subsequent mounting step, actuating arms 20 are releasably latched to the two drive devices 16. The actuating arms 20 serve to move a furniture flap which is movable in respect of height and can be connected to a furniture flap without the use of a tool by way of the fastening devices 20*a*, by way of a snap connection, and can also be removed therefrom again without a tool.

Figure 9:
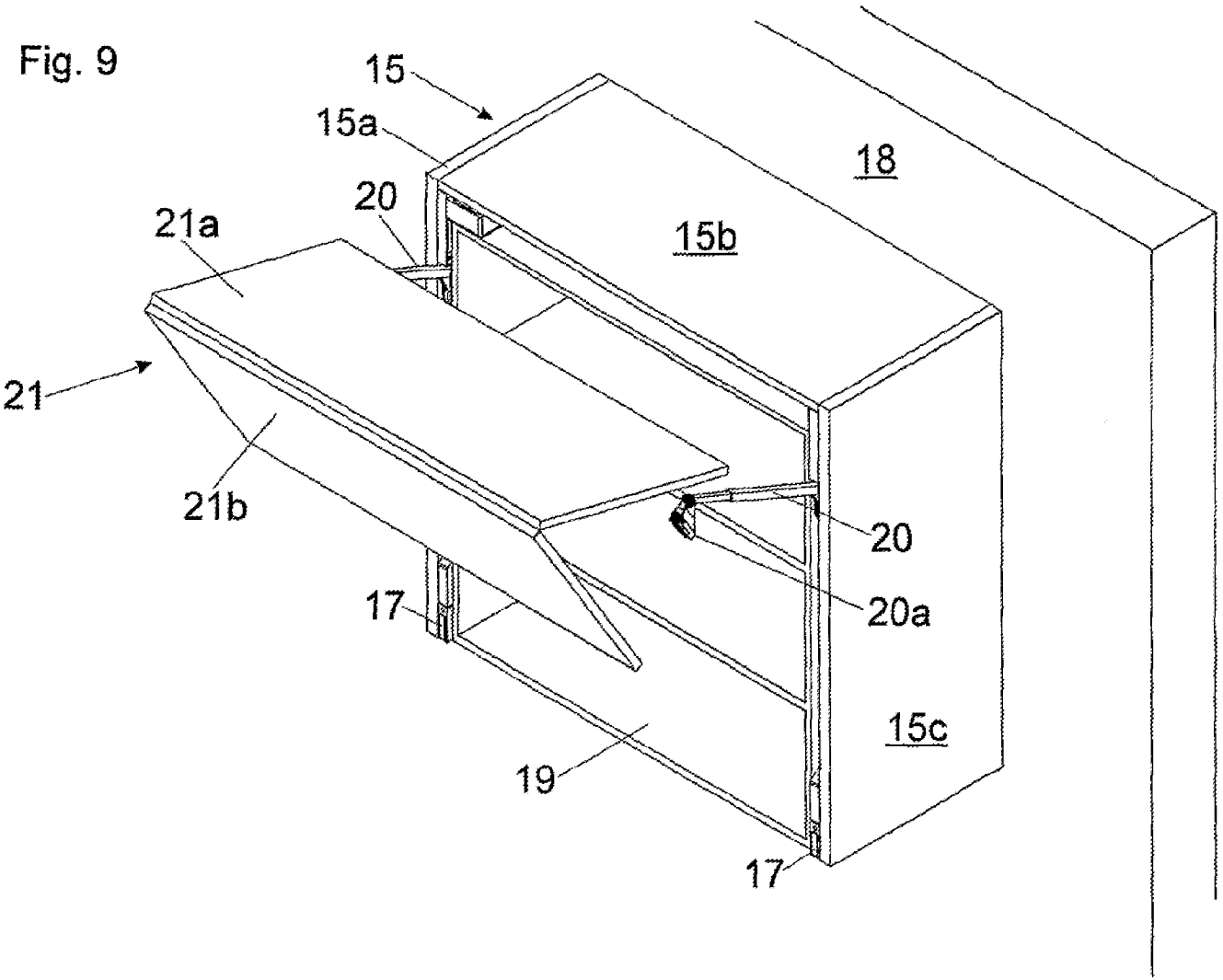
FIG. 9 shows the article of furniture fastened to the wall with the furniture flap to be mounted in place.

FIG. 9 shows mounting of the furniture flap 21 which is movable in respect of height and which in the illustrated embodiment includes two flap portions 21*a* and 21*b*. The upper flap portion 21*a* is arranged with respect to the carcass by way of a hinge system known in the state of the art. The lower flap portion 21*b* is hingedly connected to the upper flap portion 21*a* and fixed to the fastening devices 20*a* of the actuating arms 20.

Figure 10:
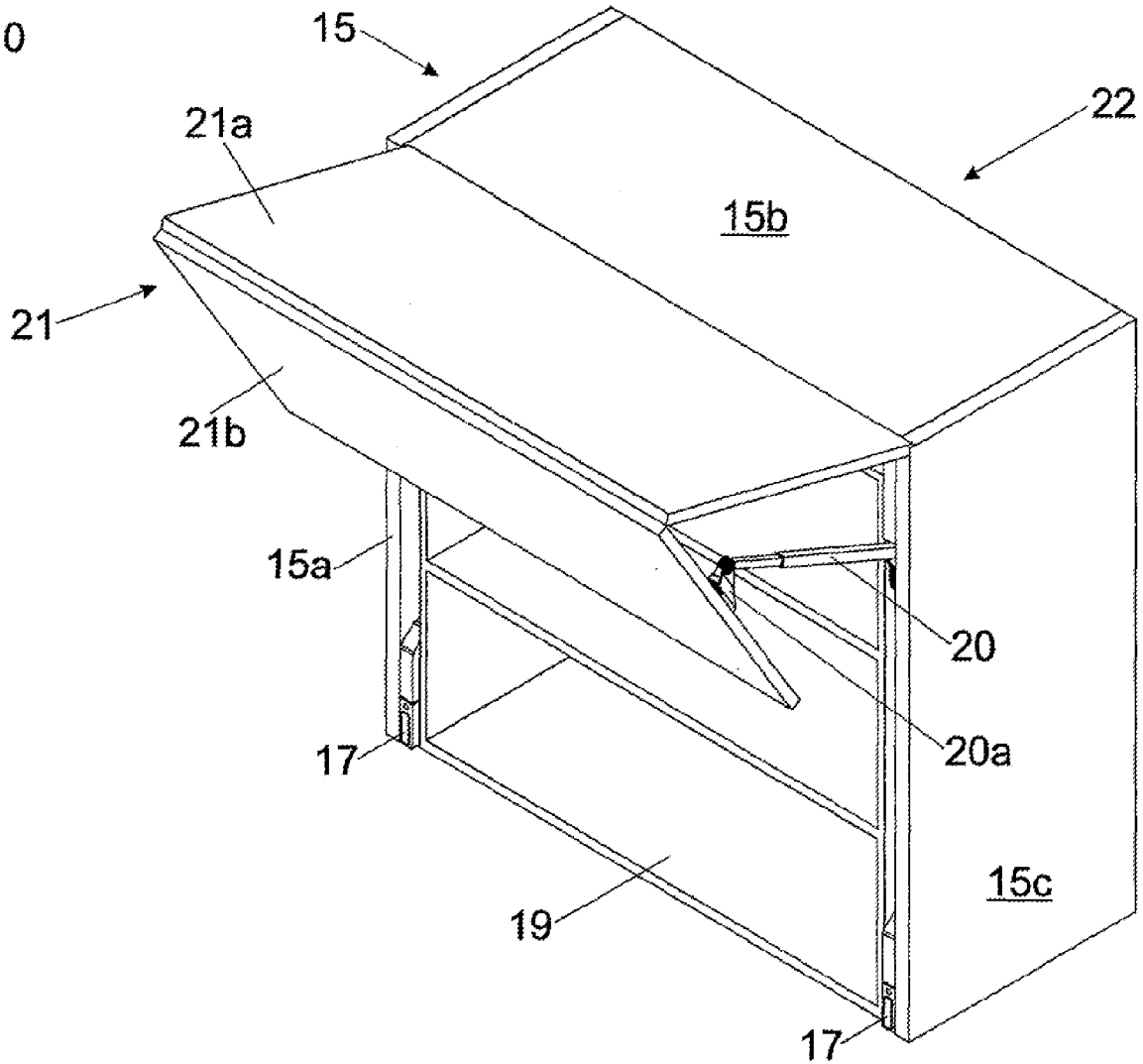
FIG. 10 shows the article of furniture in its entirety with the opened furniture flap.

FIG. 10 shows the arrangement of the article of furniture 22 with the mounted outer carcass 15, the mounted inner carcass 19 and the connected furniture flap 21. The inner carcass 19 can be lowered as desired by the actuation of a switch 17, in which case the inner carcass 19 can be more easily filled with items to be stowed therein. The illustrated article of furniture 22 can be used in particular as an upper cupboard in kitchens.

Figure 11:
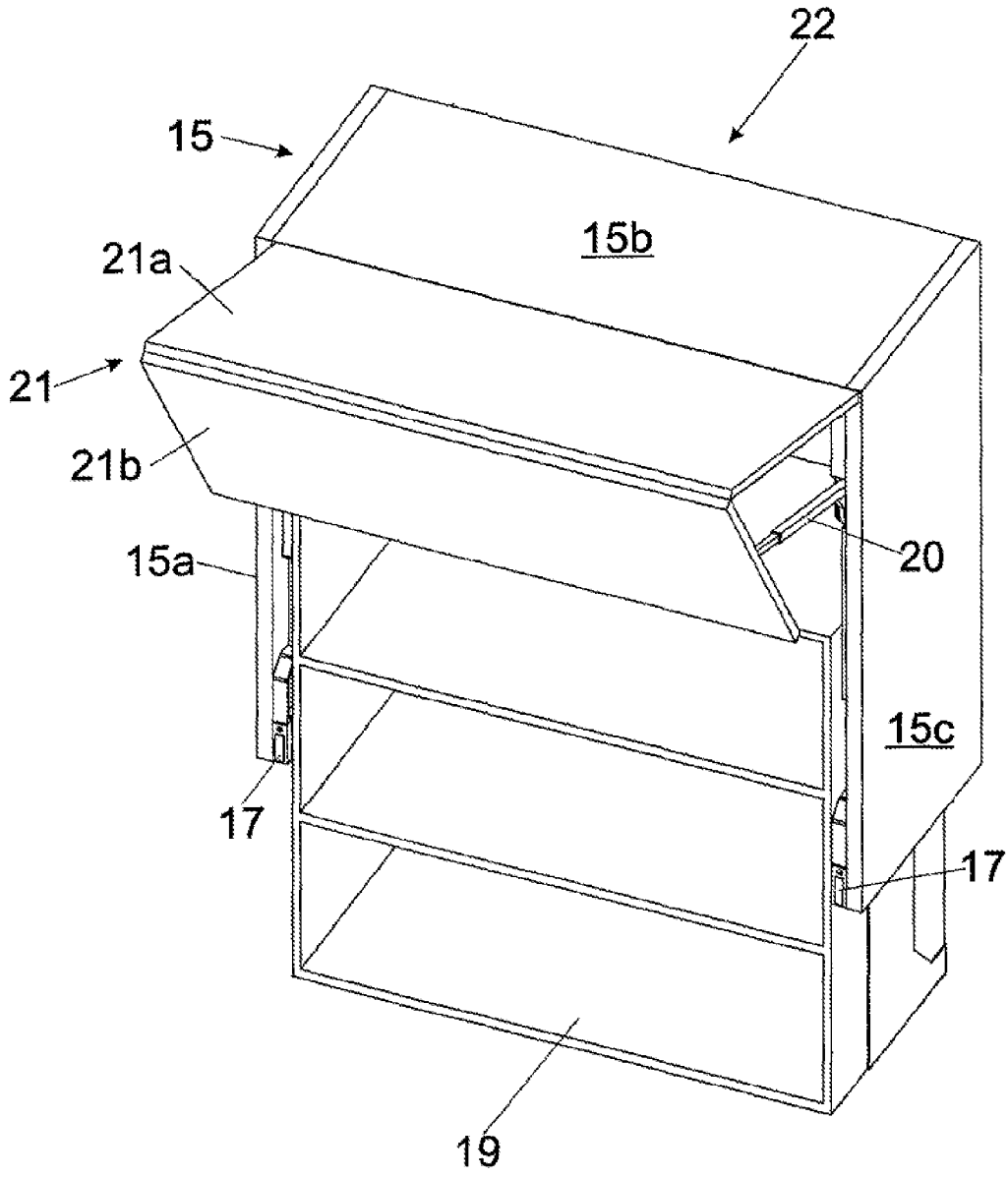
FIG. 11 shows the article of furniture with the opened furniture flap and the lowered inner carcass.

FIG. 11 shows the article of furniture 22 with the stationary outer carcass 15 and an inner carcass 19 which has been lowered relative thereto. By actuation of a switch 17, the inner carcass 19 can be moved into the upper end position again, in which case the inner carcass 19 is substantially completely accommodated within the outer carcass 15. In the illustrated embodiment, the inner carcass 19 is movable in a manner independent of the movement of the furniture flap 21, but there can also be a motion coupling between the movement of the furniture flap 21 and the movement of the downwardly movable inner carcass 19.

Figure 12B:
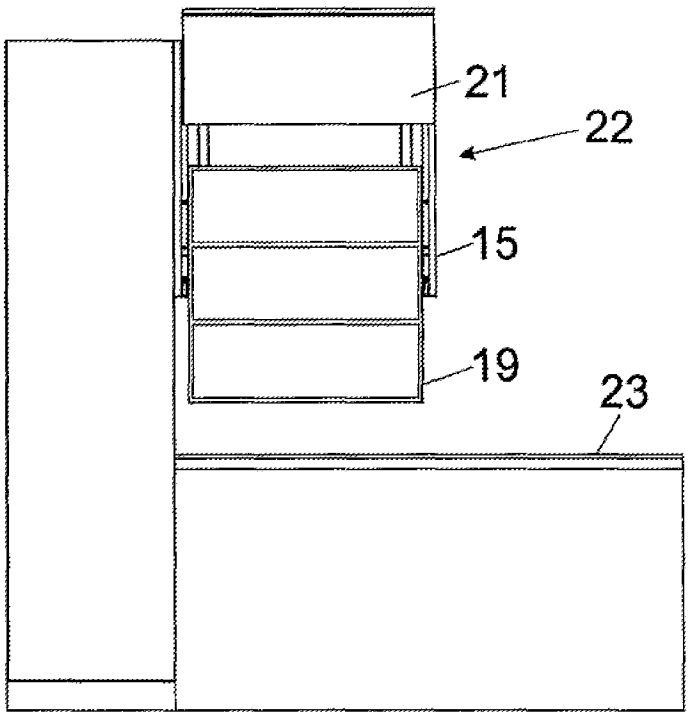
FIGS. 12*a*, 12*b* show a typical installation situation of the article of furniture as an upper cupboard in a kitchen, with the inner carcass in an upper and in a lowered lower end position.
Figure 12A:
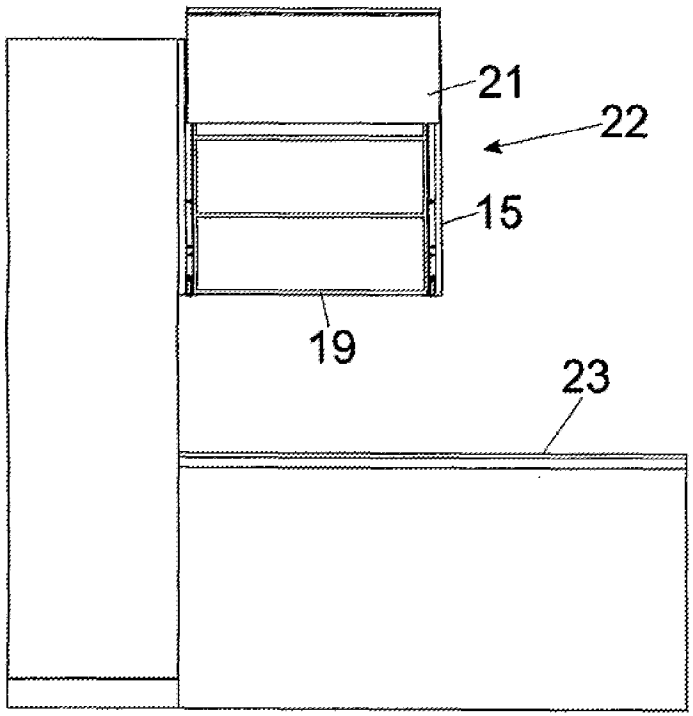

FIG. 12*a* shows a typical installation situation of the article of furniture 22 which can be used in particular as an upper cupboard in kitchens. The article of furniture 22 has the stationary outer carcass 15 with opened furniture flap 21 and the inner carcass 19 in the upper end position. FIG. 12*b* shows the inner carcass 19 which has been lowered so that the inner carcass 19 has been moved closer to the worktop 23. In that way the inner carcass 19 can be more easily filled with items to be stowed therein and also facilitates taking stored articles therefrom.

The present invention is not limited to the illustrated embodiments, but includes or extends to all variants or technical equivalents which can fall within the scope of the claims appended hereto. The positional references adopted in the description such as for example up, down, lateral, left, right are also related to the usual position of installation of the supporting structure 11 or to the directly described and illustrated Figure and are to be appropriately transferred to the new position upon a change in position.

The invention claimed is:

1. A supporting structure to be mounted to a wall for supporting an article of furniture, said supporting structure comprising:

a wall holder to be mounted directly to a wall, said wall holder being a discrete component separate from an outer furniture carcass of the article of furniture;

two side elements arranged in a spaced-apart relationship, each of said side elements including:

a vertically movable supporting element at an inner side thereof, said supporting element having a horizontal support limb for supporting an inner furniture carcass; and a side portion having a framework with a strut structure; and a transverse member releasably connecting said side elements together;

wherein said two side elements are arranged to face each other such that said horizontal support limb of said supporting element of a first one of said two side elements extends horizontally toward said horizontal support limb of said supporting element of a second one of said two side elements;

wherein at least one of said side elements and said transverse member has outer fastening locations for allowing mounting of the outer furniture carcass to said supporting structure, and said supporting element of each of said side elements has inner fastening locations for allowing mounting of the inner furniture carcass to said supporting structure;

wherein said wall holder, said side elements, and said transverse member are configured to allow said side elements and said transverse member to be mounted directly to the wall via said wall holder; wherein said side portion of each of said side elements comprises a first stationary side portion and a second movable side portion, said second movable side portion being telescopically movable in a horizontal direction relative to said first stationary side portion so as to adjust a width of each of said side elements; and wherein said second side portions have at least one holding device supporting a drive device for moving a furniture flap.

2. The supporting structure according to claim 1, wherein at least one of said side elements has an upper portion projecting substantially at a right angle from said side portion.

3. The supporting structure according to claim 2, wherein said upper portion is configured to receive and support an electric drive device.

4. The supporting structure according to claim 1, wherein at least one of said side elements is configured to have a variable length in at least one direction so that a size of said at least one of said side elements can be adjusted based on a size of the inner furniture carcass.

5. The supporting structure according to claim 4, wherein each of said at least one of said side elements has at least two portions displaceably connected to each other for varying a length of said at least one of said side elements.

6. The supporting structure according to claim 1, further comprising a transverse strut connecting said side elements together, said transverse strut being spaced apart from said transverse member.

7. The supporting structure according to claim 1, further comprising an electric drive device and a transmission mechanism for moving said supporting element of at least one of said side elements in a vertically linear direction while said supporting element holds the inner furniture carcass to thereby move the inner furniture carcass in the vertically linear direction.

8. The supporting structure according to claim 1, wherein said transverse member is configured to receive and support a power supply device.

9. The supporting structure according to claim 1, wherein said holding device comprises a recess, said drive device being inserted into and fixed within said recess.

10. The supporting structure according to claim 1, wherein said outer fastening locations are located at an outer periphery of at least one of said side elements and said transverse member.

11. An article of furniture to be mounted to a wall, said article of furniture comprising:

an outer furniture carcass;

an inner furniture carcass with shelves to receive and accommodate stored goods; and a supporting structure to be mounted to a wall, said supporting structure including:

a wall holder to be mounted directly to a wall, said wall holder being a discrete component separate from said outer furniture carcass;

two side elements arranged in a spaced-apart relationship, each of said side elements including:

a vertically movable supporting element at an inner side thereof, said supporting element having a horizontal support limb for supporting said inner furniture carcass; and a side portion having a framework with a strut structure; and a transverse member releasably connecting said side elements together;

wherein said two side elements are arranged to face each other such that said horizontal support limb of said supporting element of a first one of said two side elements extends horizontally toward said horizontal support limb of said supporting element of a second one of said two side elements;

wherein at least one of said side elements and said transverse member has outer fastening locations for mounting said outer furniture carcass to said supporting structure, and said supporting element of each of said side elements has inner fastening locations for mounting said inner furniture carcass to said supporting structure; and wherein said wall holder, said side elements, and said transverse member are configured and arranged so as to mount said side elements and said transverse member directly to the wall via said wall holder; wherein said side portion of each of said side elements comprises a first stationary side portion and a second movable side portion, said second movable side portion being telescopically movable in a horizontal direction relative to said first stationary side portion so as to adjust a width of each of said side elements; and wherein said second side portions have at least one holding device supporting a drive device for moving a furniture flap.

12. The article of furniture according to claim 11, wherein said outer furniture carcass has plate-shaped wall portions.

13. The article of furniture according to claim 12, wherein a size of said plate-shaped wall portions substantially corresponds to a size of said inner furniture carcass.

14. The article of furniture according to claim 11, wherein at least one of said side elements is configured to have a variable length in at least one direction so that a size of said at least one of said side elements can be adjusted based on a size of said inner furniture carcass.

15. The article of furniture according to claim 14, wherein each of said at least one of said side elements has at least two portions displaceably connected to each other for varying a length of said at least one of said side elements.

16. The article of furniture according to claim 11, wherein said supporting structure further includes an electric drive device and a transmission mechanism for moving said supporting element of at least one of said side elements in a vertically linear direction while said supporting element holds the inner furniture carcass to thereby move the inner furniture carcass in the vertically linear direction.

* * * * *